US010093071B2

(12) United States Patent
Makita et al.

(10) Patent No.: US 10,093,071 B2
(45) Date of Patent: Oct. 9, 2018

(54) RECORDING-MEDIUM BINDING DEVICE AND RECORDING-MEDIUM POST PROCESSING APPARATUS

(71) Applicant: FUJI XEROX CO., LTD., Tokyo (JP)

(72) Inventors: Takuya Makita, Kanagawa (JP); Hiroaki Awano, Kanagawa (JP); Yoshinori Nakano, Kanagawa (JP); Kojiro Tsutsumi, Kanagawa (JP); Katsumi Harada, Kanagawa (JP); Toshiyasu Yukawa, Kanagawa (JP); Junichi Hirota, Kanagawa (JP); Yasuhiro Kusumoto, Kanagawa (JP); Hiroshi Hagiwara, Kanagawa (JP); Emiko Shiraishi, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/469,650

(22) Filed: Mar. 27, 2017

(65) Prior Publication Data

US 2017/0283207 A1 Oct. 5, 2017

(30) Foreign Application Priority Data

Mar. 29, 2016 (JP) ..... 2016-066533
Oct. 21, 2016 (JP) ..... 2016-206524

(51) Int. Cl.
*B31F 5/02* (2006.01)
*B65H 37/04* (2006.01)
(Continued)

(52) U.S. Cl.
CPC ..... *B31F 5/02* (2013.01); *B42B 5/00* (2013.01); *B65H 37/04* (2013.01);
(Continued)

(58) Field of Classification Search
CPC ..... B65H 37/04; B65H 2301/43828; B65H 2301/51616; B65H 2801/27; B42B 5/02; G03G 15/6544; G03G 2215/00852
(Continued)

(56) References Cited

U.S. PATENT DOCUMENTS 8,333,372 B2 * 12/2012 Awaya ..... B65H 37/04 270/58.07
8,596,633 B2 * 12/2013 Awaya ..... B65H 37/04 270/58.07
(Continued)

FOREIGN PATENT DOCUMENTS

JP 2016-079000 A 5/2016

*Primary Examiner* — Leslie A Nicholson, III
(74) *Attorney, Agent, or Firm* — Sughrue Mion, PLLC

(57) ABSTRACT

A recording-medium binding device includes a first tooth row that includes teeth arranged in a tooth arrangement direction and a second tooth row that includes teeth, that is to be engaged with the first tooth row, and that cooperates with the first tooth row to bind recording media by pinching a batch of the recording media. In the tooth arrangement direction, the first and the second tooth rows have first and second ranges. In the first range, an engaging height is a first engaging height, and a width of an effective tooth top is a first effective tooth top width. In the second range, the engaging height is a second engaging height that is smaller than the first engaging height, and a width of an effective tooth top is a second effective tooth top width that is larger than the first effective tooth top width.

12 Claims, 8 Drawing Sheets

(51) Int. Cl.
*G03G 15/00* (2006.01)
*B42B 5/00* (2006.01)
*B42B 5/02* (2006.01)

(52) U.S. Cl.
CPC ..... *G03G 15/6544* (2013.01); *B42B 5/02* (2013.01); *B65H 2301/43828* (2013.01); *B65H 2301/51616* (2013.01); *B65H 2801/27* (2013.01); *G03G 2215/00852* (2013.01)

(58) Field of Classification Search
USPC ..... 270/58.07, 58.08
See application file for complete search history.

(56) References Cited

U.S. PATENT DOCUMENTS

| | | | | |
|---|---|---|---|---|
| 8,845,258 | B2 * | 9/2014 | Mori | B42B 5/00 412/33 |
| 9,102,492 | B2 * | 8/2015 | Saito | B65H 39/00 |
| 9,254,621 | B2 * | 2/2016 | Takahashi | B42C 13/00 |
| 2016/0107409 | A1 | 4/2016 | Kubo | |
| 2017/0174465 | A1 * | 6/2017 | Morinaga | B31F 5/02 |
| 2017/0217239 | A1 * | 8/2017 | Suzuki | B42C 1/12 |
| 2017/0282482 | A1 * | 10/2017 | Awano | B31F 5/02 |
| 2017/0282483 | A1 * | 10/2017 | Makita | B31F 5/02 |

* cited by examiner

RECORDING-MEDIUM BINDING DEVICE AND RECORDING-MEDIUM POST PROCESSING APPARATUS

CROSS-REFERENCE TO RELATED APPLICATIONS

This application is based on and claims priority under 35 USC 119 from Japanese Patent Application Nos. 2016-066533 filed Mar. 29, 2016 and 2016-206524 filed Oct. 21, 2016.

BACKGROUND (i) Technical Field

The present invention relates to a recording-medium binding device and a recording-medium post processing apparatus.

(ii) Related Art

With a known recording-medium binding device, stacked plural recording media are subjected to pressure by pinching the recording media with a pair of tooth rows engaged with each other, so that the recording media are deformed into a waveform shape so as to be combined with one another. With such a recording-medium binding device, there exists an appropriate engaging height of teeth of mutually engaged tooth rows in accordance with the thickness of a batch of recording media. In the case of a thin batch of recording media, it is possible to deform the recording media into a waveform shape with a small engaging height of teeth. However, when it is attempted to bind a thick batch of recording media to one another with tooth rows of a small engaging height, in some cases it is not possible to deform the recording media sufficiently to combine the recording media with one another. In the case of a thick batch of recording media, it is possible to bind the recording media to one another with tooth rows of a large engaging height. In contrast, when it is attempted to bind a thin batch of recording media to one another with tooth rows of a large engaging height, in some cases the recording media are broken. In this case, the recording media are not combined with one another.

SUMMARY

According to an aspect of the present invention, a recording-medium binding device includes a first tooth row that includes plural teeth arranged in a tooth arrangement direction. The recording-medium binding device also includes a second tooth row that includes plural teeth, that is to be engaged with the first tooth row, and that cooperates with the first tooth row to bind recording media by pinching a batch of the recording media. In the tooth arrangement direction, the first tooth row and the second tooth row have at least one first range and at least one second range. In the at least one first range, an engaging height by which at least one tooth of the plural teeth of the first tooth row and at least one tooth of the plural teeth of the second tooth row are engaged with each other is a first engaging height, and a width of an effective tooth top is a first effective tooth top width. In the at least one second range, the engaging height is a second engaging height that is smaller than the first engaging height, and a width of an effective tooth top is a second effective tooth top width that is larger than the first effective tooth top width.

BRIEF DESCRIPTION OF THE DRAWINGS

Exemplary embodiment of the present invention will be described in detail based on the following figures, wherein.

DETAILED DESCRIPTION

Figure 1:
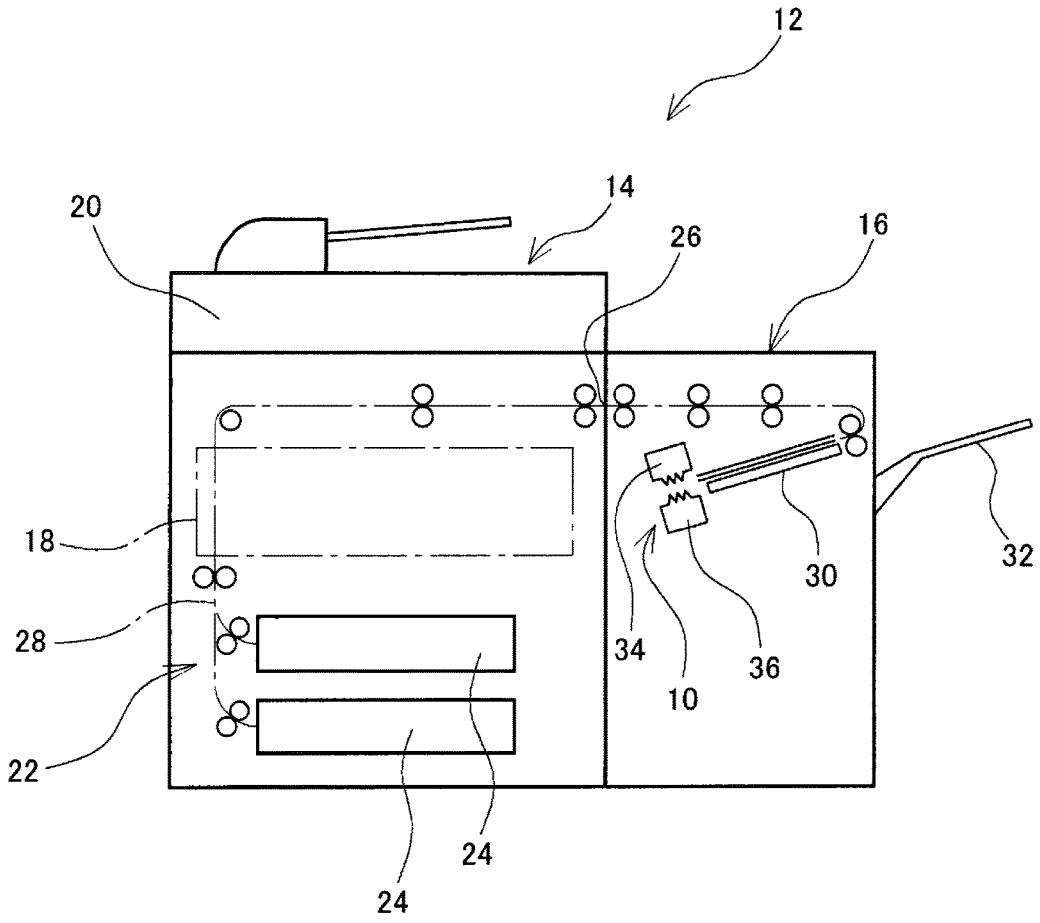
FIG. 1 schematically illustrates the structure of an image forming system.

An exemplary embodiment of the present invention will be described below with reference to the drawings. FIG. 1 is a schematic diagram of the structure of an image forming system 12 that includes a recording-medium binding device 10 according to the present exemplary embodiment. The image forming system 12 includes an image forming apparatus 14 and a recording-medium post processing apparatus 16. The image forming apparatus 14 has functions such as, for example, electrophotographic printing and copying functions. The recording-medium post processing apparatus 16 performs post processes such as, for example, punching and binding on recording media on which images have been formed by the image forming apparatus 14. The recording-medium binding device 10 according to the present exemplary embodiment is mountable in the recording-medium post processing apparatus 16.

The image forming apparatus 14 includes an image forming section 18 that forms toner images in accordance with obtained document information. The document information may be obtained by reading a document with a document reader 20 included in the image forming apparatus 14 or obtained from an external device. The image forming apparatus 14 further includes a recording-medium feeding mechanism 22. The recording media to be fed are sheet-shaped recording media having been cut into rectangular shapes made of, for example, paper. The recording-medium feeding mechanism 22 includes feed trays 24 and a transport path 28. The feed trays 24 hold the recording media stacked thereon. The transport path 28 allows the recording media to be fed therethrough from the feed trays 24 to an output opening 26. The toner images having been formed by the image forming section 18 is received by and fixed onto the recording media while the recording media are transported through the transport path 28. The recording media having been output through the output opening 26 are received by the recording-medium post processing apparatus 16.

The recording media received by the recording-medium post processing apparatus 16 are accumulated on an accumulation tray 30 according to need so as to form a batch of recording media. In the case where the accumulation is not required, the recording media are fed to an output tray 32. When a predetermined number of recording media are accumulated on the accumulation tray 30, the recording media are bound by the recording-medium binding device 10. The recording-medium binding device 10 includes two tooth rows 34 and 36 that are paired with each other. Each of the tooth rows 34 and 36 includes plural teeth arranged thereon. For convenience of distinguishing between two tooth rows, the tooth rows illustrated on the upper and lower sides of FIG. 1 are respectively referred to as the upper tooth row 34 and the lower tooth row 36. It is sufficient that two tooth rows 34 and 36 face each other with the recording media to be bound pinched therebetween. For example, the tooth rows 34 and 36 are respectively arranged on the left and right, or the upper tooth row 34 and the lower tooth row 36 are respectively disposed on the lower and upper sides.

One or both of the upper tooth row 34 and the lower tooth row 36 are advanced toward and retracted from the other or each other by a drive mechanism. When one or both of the upper tooth row 34 and the lower tooth row 36 are advanced, the upper tooth row 34 and the lower tooth row 36 are engaged with each other. When the tooth rows are engaged with each other, the recording media pinched therebetween are deformed into a wave shape, combined with one another, and bound to one another. The batch of recording media having been bound is fed to the output tray 32.

Figure 2A:
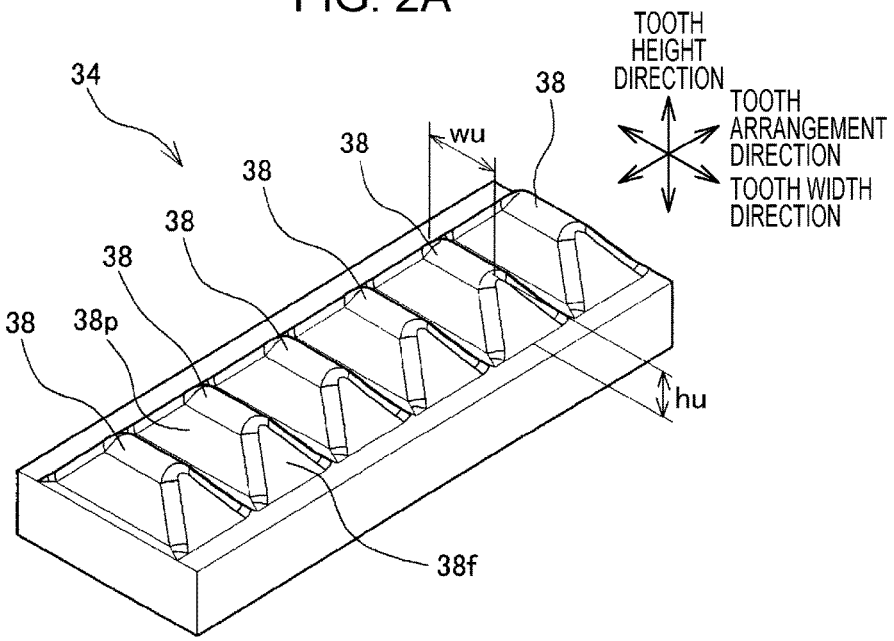
FIGS. 2A and 2B are respectively perspective views of an upper tooth row and a lower tooth row of a recording-medium binding device according to an exemplary embodiment.
Figure 2B:
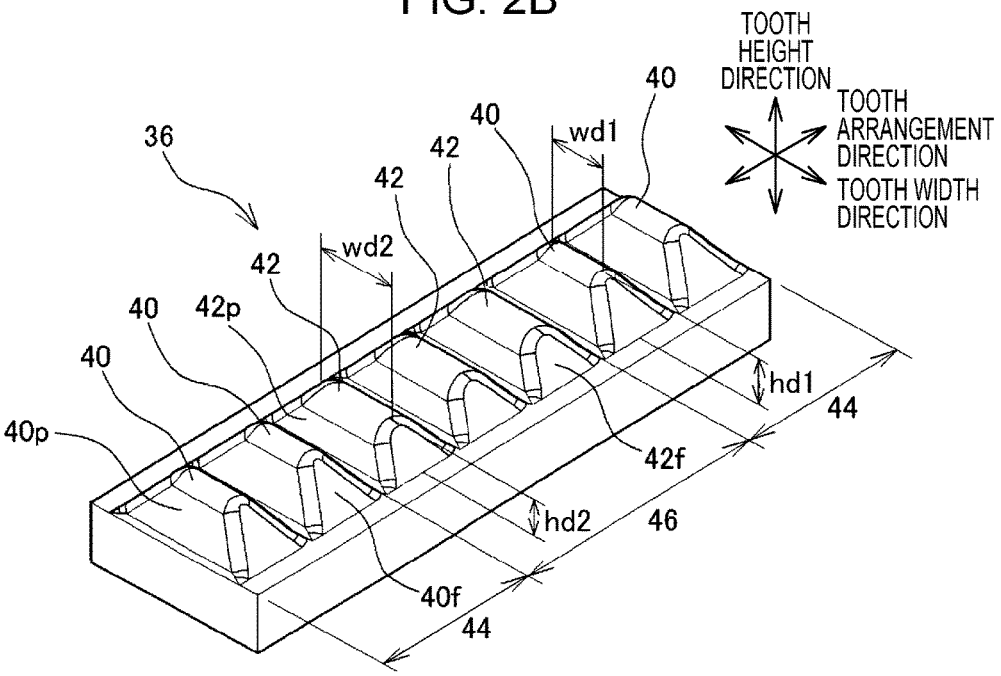
Figure 3:
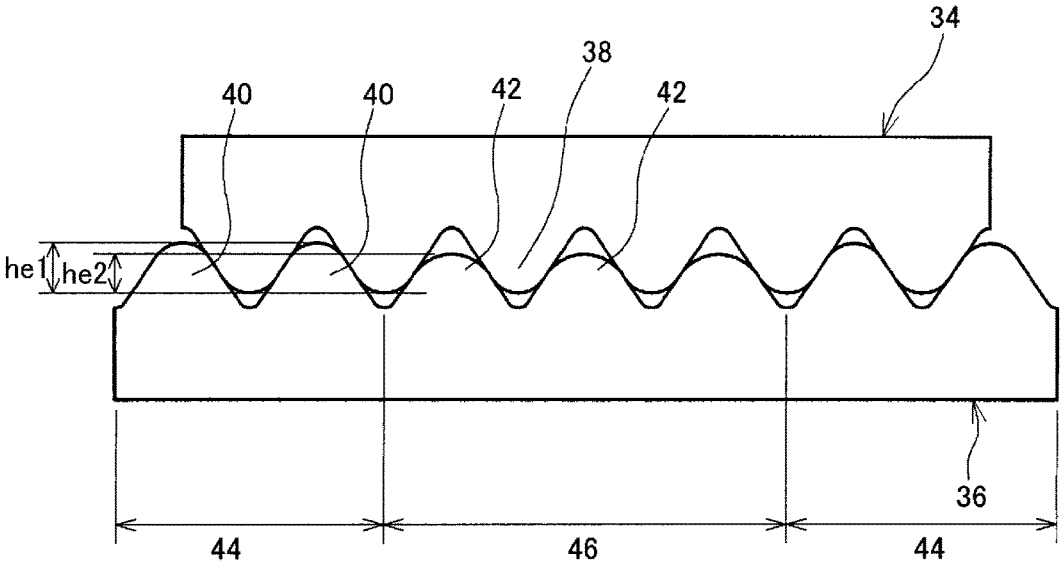
FIG. 3 is a sectional view of the upper tooth row and the lower tooth row engaged with each other.

FIGS. 2A and 2B are perspective views respectively illustrating the upper tooth row 34 and the lower tooth row 36. As indicated in FIGS. 2A and 2B, a direction in which the teeth are arranged is referred to as a "tooth arrangement direction", a direction of the height of the teeth is referred to as a "tooth height direction", and a direction perpendicular to the tooth arrangement direction and the tooth height direction is referred to as a "tooth width direction" in the following description. FIG. 3 is a section perpendicular to the tooth width direction, illustrating the upper tooth row 34 and the lower tooth row 36 in engagement with each other.

As illustrated in FIG. 2A, the upper tooth row 34 includes six upper teeth 38 that have the same tooth height hu and the same tooth top width wu. As illustrated in FIG. 2B, the lower tooth row 36 includes seven lower teeth 40 and 42. More specifically, the lower tooth row 36 includes four lower high teeth 40 and three lower low teeth 42. The upper teeth 38, the lower high teeth 40, and the lower low teeth 42 have substantially isosceles trapezoidal shapes when seen in the tooth arrangement direction. A tooth height hd2 of the lower low teeth 42 is smaller than a tooth height hd1 of the lower high teeth 40. A tooth top width wd2 of the lower low teeth 42 is larger than a tooth top width wd1 of the lower high teeth 40. A tooth height hu of the upper teeth 38 is equal to a tooth height hd1 of the lower high teeth 40. The tooth top width wu of the upper teeth 38 is equal to the tooth top width wd1 of the lower high teeth 40 or smaller. As illustrated in FIG. 3, the bottoms of tooth grooves between the upper teeth 38 of the upper tooth row 34 are positioned at the same level in the tooth height direction. Likewise, the bottoms of tooth grooves of the lower tooth row 36 are positioned at the same level. Two each of the lower high teeth 40 are arranged on both sides of three lower low teeth 42. Ranges where the lower high teeth 40 are arranged are referred to as high tooth ranges 44, and a range where the lower low teeth 42 are arranged is referred to as a low tooth range 46.

Figure 4:
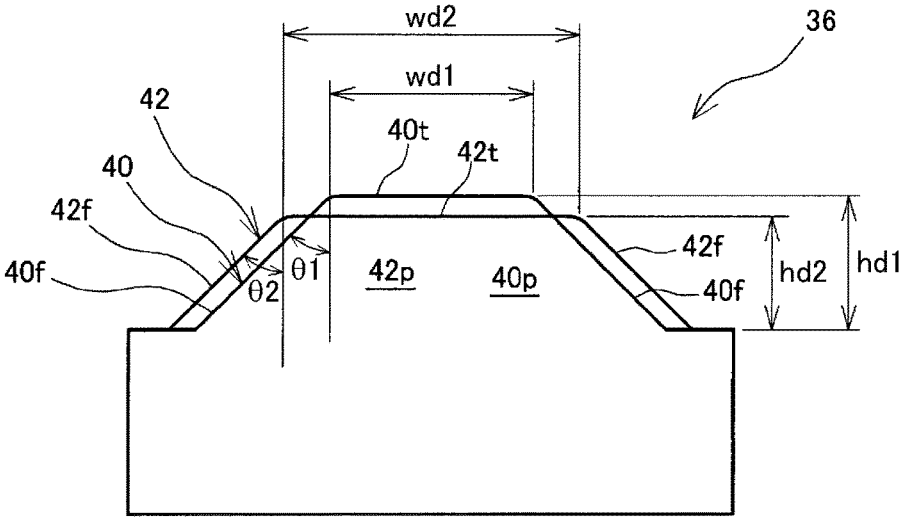
FIG. 4 illustrates lower high teeth and lower low teeth seen in a tooth arrangement direction.

FIG. 4 illustrates the lower high teeth 40 and the lower low teeth 42 seen in the tooth arrangement direction. Although corners formed between a tooth top 40*t* and tooth side surfaces 40*f* of each of the lower high teeth 40 are rounded, the tooth top width wd1 is defined as the length of tooth tops 40*t* while it is assumed that the corners are not rounded. That is, lines that pass through the left and right tooth side surfaces 40*f* and the tooth top 40*t* are assumed, and the distance between intersections of the assumed lines in the tooth width direction is defined as the tooth top width wd1. Likewise, lines passing through left and right tooth side surfaces 42*f* and a tooth top 42*t* of each of the lower low teeth 42 are assumed, and the distance between intersections of the assumed lines in the tooth width direction is defined as the tooth top width wd2. Central positions of the tooth top 40*t* of the lower high tooth 40 and the tooth top 42*t* of the lower low tooth 42 are aligned with each other in the tooth width direction. As illustrated in FIG. 4, the tooth top 42*t* of the lower low tooth 42 extends beyond the left and right tooth side surfaces 40*f* of the lower high tooth 40. As illustrated in FIG. 4, each of the tooth side surfaces 40*f* of the lower high tooth 40 is inclined at an inclination angle θ1 relative to the tooth height direction, and each of the tooth side surfaces 42*f* of the lower low tooth 42 is inclined at an inclination angle θ2 relative to the tooth height direction. These inclination angles θ1 and θ2 are equal to each other in the present recording-medium binding device 10.

Figure 5:
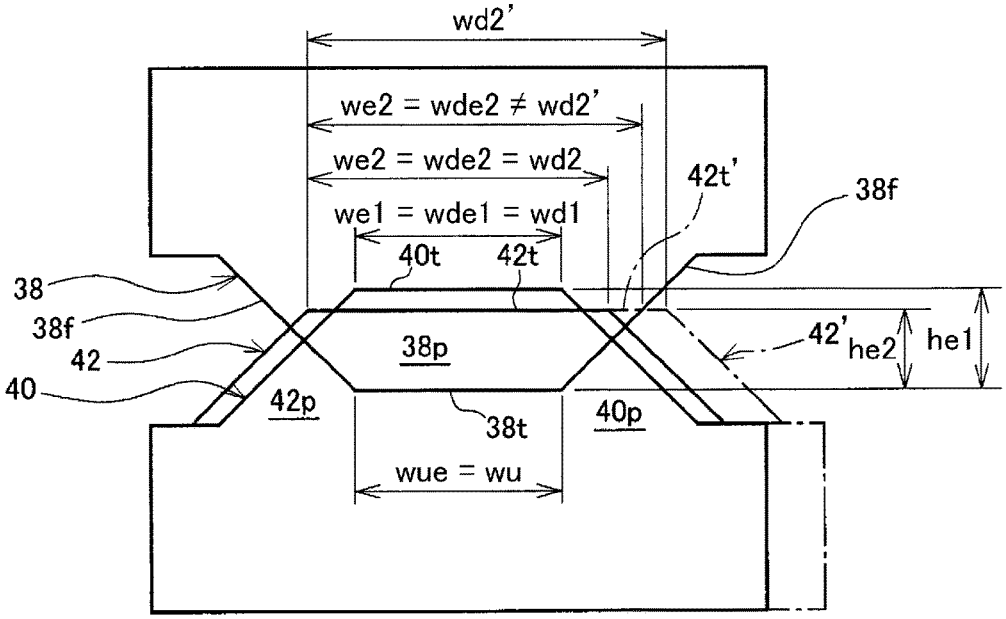
FIG. 5 illustrates the relationships between upper teeth, the lower high teeth, and the lower low teeth.

FIG. 5 illustrates the upper teeth 38, the lower high teeth 40, and the lower low teeth 42 superposed on one another when seen in the tooth arrangement direction. The centers of a tooth top 38*t* of each of the upper teeth 38 and the tooth top 40*t* of each of the lower high teeth 40 are aligned with each other in the tooth width direction. The inclination of tooth side surfaces 38*f* of the upper tooth 38 is equal to that of the tooth side surfaces 40*f* of the lower high tooth 40. The tooth top 40*t* of the lower high tooth 40 and the tooth top 42*t* of each of the lower low teeth 42 are disposed within a tooth surface 38*p* of the upper tooth 38. That is, the tooth top 40*t* and the tooth top 42*t* are disposed inside the left and right tooth side surfaces 38*f* of the upper tooth 38. In such a case, the entirety of the tooth top width wd1 and the entirety of the tooth top width wd2 contribute to combining of the recording media. That is, when the upper tooth row 34 and the lower tooth row 36 are brought into engagement with each other, the recording media are pressed into spaces between the upper teeth 38 and pressed against tooth surfaces 38P of the upper teeth 38 by the tooth tops 40*t* and the tooth tops 42*t*. This causes the recording media to be combined with one another. Accordingly, in the lower high teeth 40, a tooth top length wde1 contributing to the combining of the recording media agrees with the tooth top width wd1. Also, in the lower low teeth 42, a tooth top length wde2 contributing to the combining of the recording media agrees with the tooth top width wd2.

In contrast, as is the case with a lower low tooth 42' illustrated by a dotted-chain line in FIG. 5, when a tooth top 42*t'* extends beyond the tooth surface 38*p* of the upper tooth 38, part of the tooth top 42*t'* beyond the tooth surface 38*p* does not contribute to the combining of the recording media. Accordingly, in this case, the tooth top length wde2 contributing to the combining of the recording media is smaller than a tooth top width wd2'.

The tooth top 38*t* of the upper tooth 38 is also disposed within the tooth surfaces 40*p* and 42*p* of the lower high tooth 40 and the lower low tooth 42, and accordingly, a tooth top length wue contributing to the combining of the recording media agrees with the tooth top width wu.

The tooth top length that influences more for combining the recording media is a larger tooth top length out of the tooth top lengths of the upper tooth 38 and the lower teeth 40 and 42 to be engaged with the upper tooth 38. The tooth top length that is larger out of the tooth top lengths of the teeth in engagement contributing to the combining of the recording media is referred to as an "effective tooth top width we" and the tooth top having the effective tooth top width we is referred to as an "effective tooth top". That is, in the high tooth ranges 44, the tooth top length wde1 of the lower high tooth 40 contributing to the combining of the recording media is equal to or larger than the tooth top length wue of the upper tooth 38 contributing to the combining of the recording media, and the tooth top length wde1 is referred to as a high-tooth-range effective tooth top width we1. In the low tooth range 46, the tooth top length wde2 contributing to the combining of the recording media is a low-tooth-range effective tooth top width we2. As described above, when the tooth top extends beyond the tooth side surface of a target tooth for engagement, the effective tooth top width is determined in a range within the tooth surface of the target tooth.

In addition to the above-described dimensions in the tooth width direction, dimensions in the tooth height direction also contribute to combining forces for combining the recording media with each other. A dimension by which the teeth engaged with each other are superposed on each other in the tooth height direction is defined as an engaging height he. A high-tooth-range engaging height he1 being an engaging height of the high tooth ranges 44 is the distance between the tooth top 38*t* of the upper tooth 38 and the tooth top 40*t* of the lower high tooth 40 when the upper tooth 38 and the lower high tooth 40 are engaged with each other. Furthermore, a low-tooth-range engaging height he2 is the distance between the tooth top 38*t* of the upper tooth 38 and the tooth top 42*t* of the lower low tooth 42 when the upper tooth 38 and the lower low tooth 42 are engaged with each other.

The tooth rows 34 and 36 of the recording-medium binding device 10 have the high tooth ranges 44 and the low tooth range 46. The high tooth ranges 44 correspond to a thick batch of recording media and the low tooth range 46 corresponds to a thin batch of recording media. The thickness of the batch of recording media is determined by the number of recording media and the thickness of each of the recording media included in the batch. For example, when the thickness of each of the recording media included in batches of recording media are the same, the thickness of a batch of recording media that includes a larger number of the recording media is larger, and when the numbers of the recording media included in batches of recording media are the same, the thickness of a batch of recording media that includes the recording media the thickness of each of which is larger is larger.

When the batch of recording media is thin, most of the combining of the recording media is achieved with the low tooth range 46. The recording media are pressed into the spaces (tooth grooves) between the upper teeth 38 to be engaged with the lower low teeth 42 by the tooth tops 42*t* of the lower low teeth 42. This causes the recording media to be combined with one another and bound to one another. In the high tooth ranges 44, the recording media may be largely deformed and broken due to the large tooth height of the lower high teeth 40. When the recording media are broken, combining of the recording media is not expected at the broken portion. Thus, when the batch of recording media is thin, most of the combining is achieved with the low tooth range 46. In contrast, when the batch of the recording media is thicker, in the low tooth range 46, the recording media are not sufficiently pressed into the tooth grooves between the teeth with which the lower low teeth 42 are to be engaged. Thus, the combining forces for combining the recording media with one another are insufficient. In the high tooth ranges 44, the tooth tops 40*t* of the lower high teeth 40 more deeply press the recording media into the tooth grooves between the upper teeth 38. This increases the combining forces.

The combining forces of the recording media increase as the engaging height he increases and the effective tooth top width we increases. When the effective tooth top widths we of the high tooth ranges 44 and the low tooth range 46 are the same, the combining forces for combining a thin batch of recording media decrease due to the small engaging height he of the low tooth range 46. In order to increase the combining forces in the low tooth range 46, the low-tooth-range effective tooth top width we2 is made to be larger than the high-tooth-range effective tooth top width we1 in the present recording-medium binding device 10. As illustrated in FIG. 4, the tooth top 42*t* of the lower low tooth 42 extends beyond the tooth side surfaces 40*f* of the lower high tooth 40. When considering the fact that the lower high tooth 40 has an isosceles trapezoidal shape, the low-tooth-range effective tooth top width we2 is larger than the high-tooth-range effective tooth top width we1.

FIGS. 6 to 9 illustrate other examples of the tooth top width of the lower low teeth and the position of the tooth top of the lower low teeth in the tooth width direction. The lower high teeth 40 and the upper teeth 38 have the same configurations as those of the above-described examples. However, lower low teeth 142, 242, 342, and 442 have the tooth top widths and the positions of the tooth tops that are different from those of the above-described lower low teeth 42. These lower low teeth also have isosceles trapezoidal shapes when seen in the tooth arrangement direction. In each of the examples, the tooth height hd1 of each of the lower high teeth 40 is larger than the tooth height hd2 of each of the lower low teeth. The tooth top width wd1 of the lower high tooth 40 is smaller than the tooth top width wd2 of the lower low tooth. The tooth top 40*t* of the lower high tooth 40 and tooth tops 142*t*, 242*t*, 342*t*, and 442*t* of the lower low teeth are disposed within the tooth surface 38*p* of each of the upper teeth 38. When the tooth top width wu of the upper tooth 38 is equal to or smaller than the tooth top width wd1 of the lower high tooth 40, the effective tooth top width we2 of the low tooth range 46 is larger than the effective tooth top width we1 of the high tooth ranges 44. It is possible that the effective tooth top width we2 of the low tooth range 46 is larger than the effective tooth top width we1 of the high tooth ranges 44 in configurations different from the above-described configurations, that is, in other configurations than the configuration in which the tooth tops 40*t* of the lower high tooth 40 and the tooth tops 142*t*, 242*t*, 342*t*, and 442*t* of the lower low teeth are disposed within the tooth surface 38*p* of the upper tooth 38 and the tooth top width wu of the upper tooth 38 is equal to or smaller than the tooth top width wd1 of the lower high tooth 40.

Figure 6:
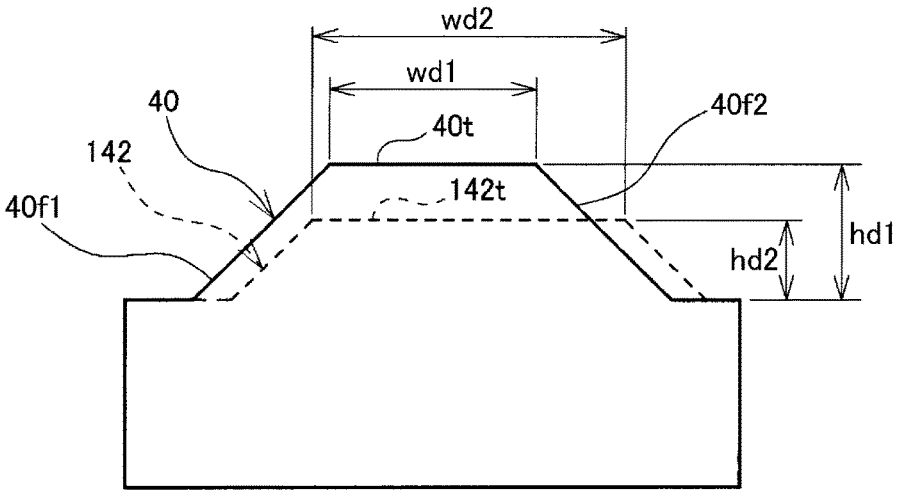
FIG. 6 illustrates another example of the lower high teeth and the lower low teeth.
Figure 7:
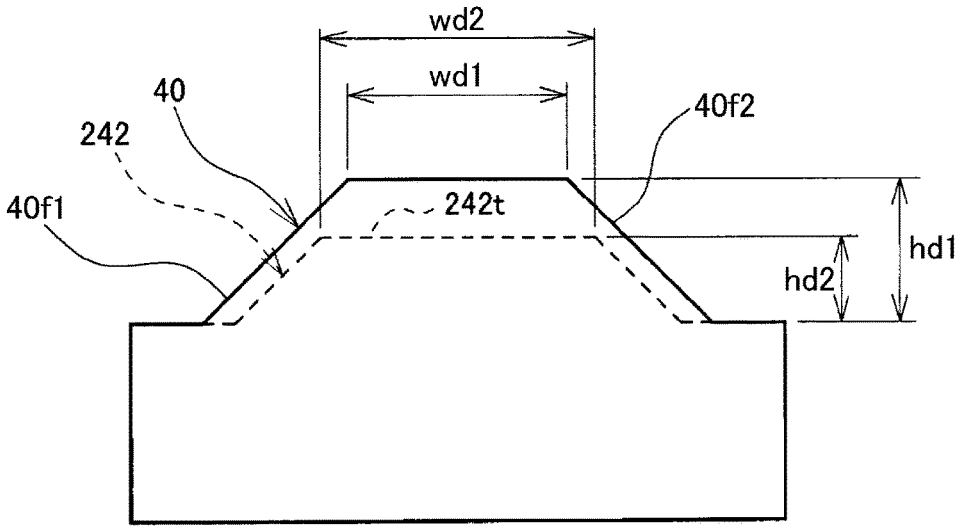
FIG. 7 illustrates yet another example of the lower high teeth and the lower low teeth.

In the example illustrated in FIG. 6, a left end of the tooth top 142*t* of the lower low tooth 142 in FIG. 6 is positioned inside a left tooth side surface 40*f* 1 of the lower high tooth 40. In contrast, a right end of the tooth top 142*t* of the lower low tooth 142 in FIG. 6 is positioned outside a right tooth side surface 40*f* 2 of the lower high tooth 40. In this case, central positions of the tooth top 40*t* of the lower high tooth 40 and the tooth top 142*t* of the lower low tooth 142 are shifted from each other in the tooth width direction. Referring to FIG. 7, both ends of the tooth top 242*t* of the lower low tooth 242 are positioned inside both the tooth side surfaces 40*f*1 and 40*f*2 of the lower high tooth 40. Although the central positions of the tooth top 40*t* of the lower high tooth 40 and the tooth top 242*t* of the lower low tooth 242 are aligned with each other in the tooth width direction in FIG. 7, these tooth tops 40*t* and 242*t* are not necessarily aligned with each other.

Figure 8:
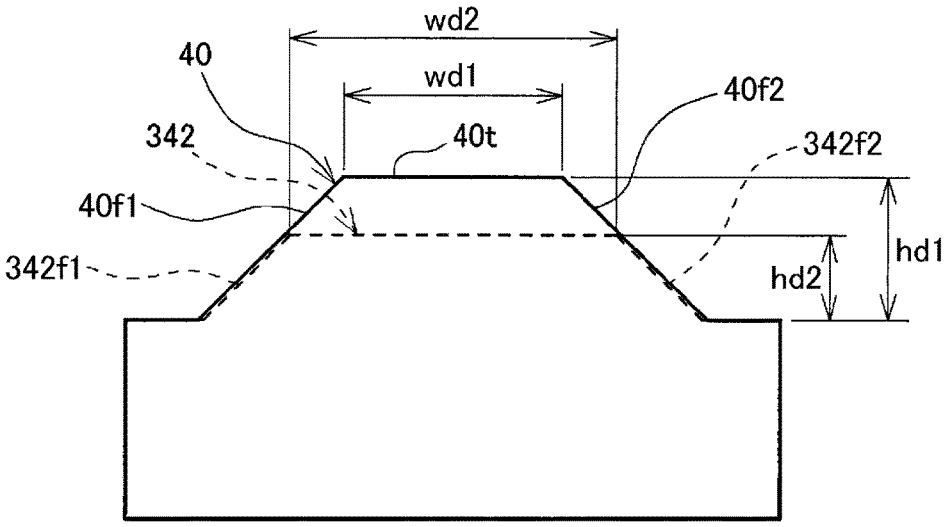
FIG. 8 illustrates yet another example of the lower high teeth and the lower low teeth.
Figure 9:
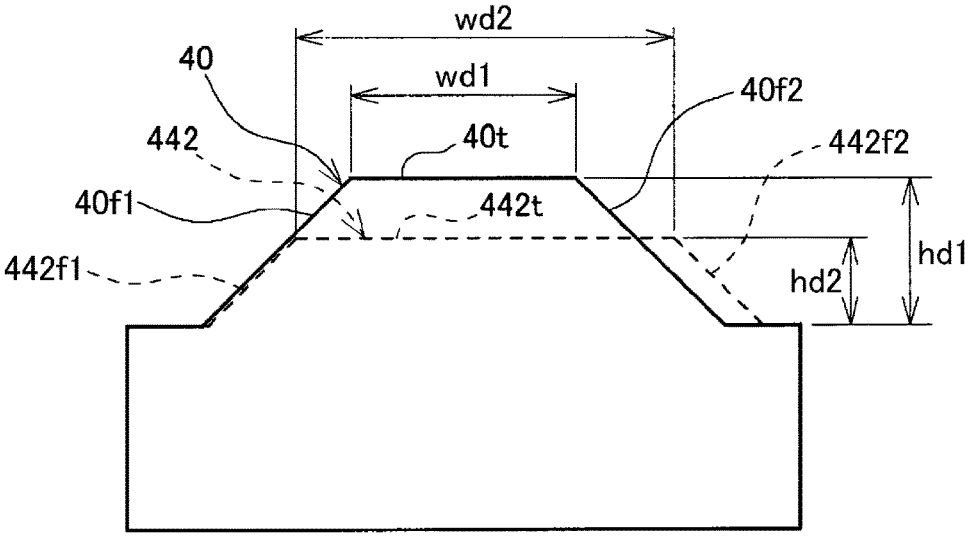
FIG. 9 illustrates yet another example of the lower high teeth and the lower low teeth.

Referring to FIG. 8, the left tooth side surface 40*f*1 of the lower high tooth 40 is superposed on a left tooth side surface 342*f*1 of the lower low tooth 342 and the right tooth side surface 40*f*2 of the lower high tooth 40 is superposed on a right tooth side surface 342*f*2 of the lower low tooth 342. Referring to FIG. 9, the left tooth side surface 40*f*1 of the lower high tooth 40 is superposed on a left tooth side surface 442*f*1 of the lower low tooth 442. However, the right tooth side surface 40*f*2 of the lower high tooth 40 is not superposed on a right tooth side surface 442*f*2 of the lower low tooth 442, and a right end of the tooth top 442*t* of the lower low tooth 442 is positioned outside the tooth side surface 40*f*2 of the lower high tooth 40. In this case, central positions of the tooth top 40*t* of the lower high tooth 40 and the tooth top 442*t* of the lower low tooth 442 are shifted from each other in the tooth width direction. Alternatively, the right end of the tooth top 442*t* of the lower low tooth 442 may be positioned inside the tooth side surface 40*f* 2 of the lower high tooth 40. Also in this case, the central positions of the tooth top 40*t* of the lower high tooth 40 and the tooth top 442*t* of the lower low tooth 442 are shifted from each other. As is the cases with FIGS. 8 and 9, when the tooth side surfaces of the lower high teeth are superposed on the tooth side surfaces of the lower low teeth, the tooth side surfaces on the same side may be processed at a time.

Figure 10:
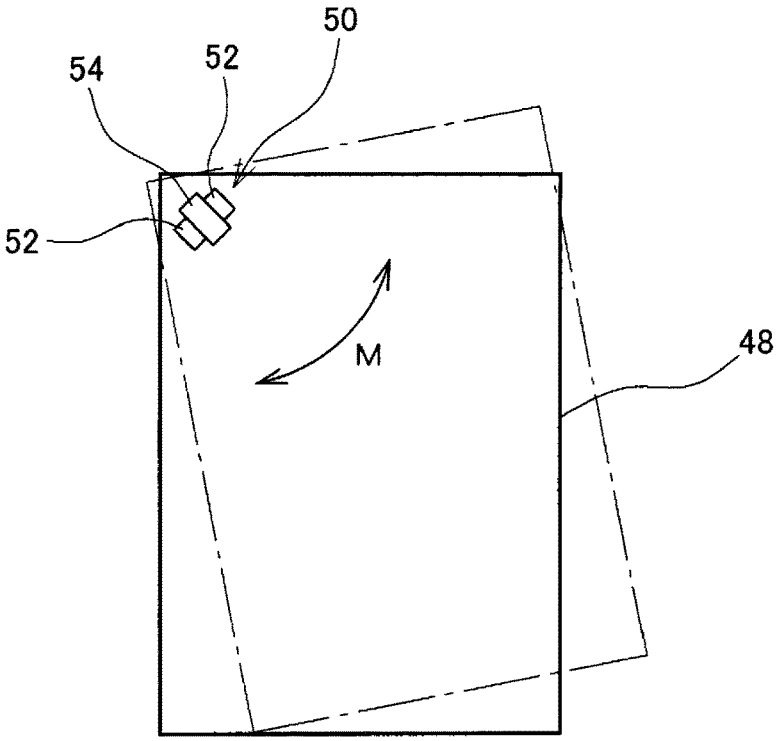
FIG. 10 illustrates bound recording media.

FIG. 10 illustrates recording media 48 and a combining region 50 where the recording media 48 are combined with one another by the recording-medium binding device 10. The combining region 50 is formed by pinching the stacked plural recording media 48 with the upper tooth row 34 and the lower tooth row 36 and deforming the recording media 48 into a waveform shape. In portions deformed with the high tooth ranges 44 of the tooth rows 34 and 36, the height of the wave is larger when the recording media 48 is deformed into the waveform shape. These portions are referred to as high-wave portions 52. Furthermore, in a portion deformed with the low tooth range 46, the height of the wave is small. This portion is referred to as a low-wave portion 54. The combining region 50 is formed corresponding to the effective tooth tops. The width of the high-wave portions 52 corresponds to the high-tooth-range effective tooth top width we1 and the width of the low-wave portion 54 corresponds to the low-tooth-range effective tooth top width we2. Following the arrangement of the low tooth range 46 and the high tooth ranges 44, two high-wave portions 52 are positioned with the low-wave portion 54 interposed therebetween. Separating two high-wave portions 52 increases forces that resist forces M, which act to rotate each of the recording media 48 of a thick batch of recording media relative to one another in a plane of the page of the recording medium 48.

Figure 11:
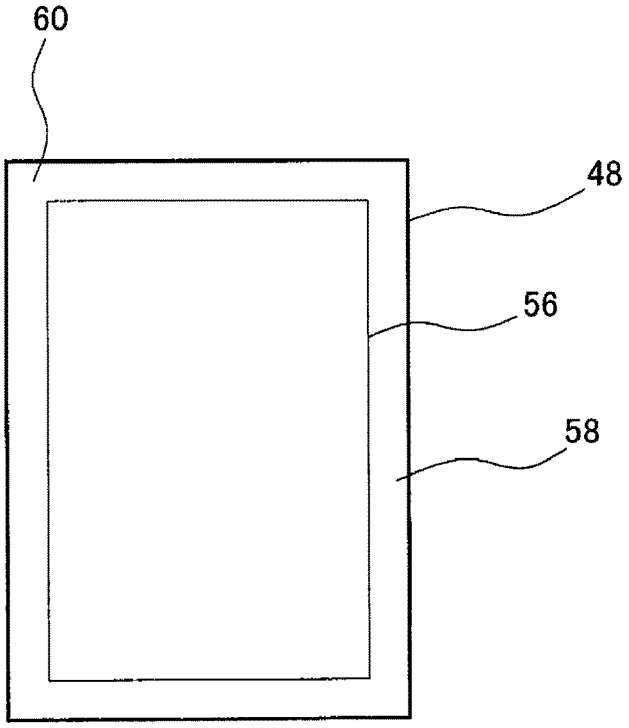
FIG. 11 illustrates a recording region and a marginal region of a recording medium.

FIG. 11 illustrates the relationship between each of the recording media 48 and a recording region 56. When content of the document is recorded in a recording medium 48 by printing or the like, margins are set around the recording region 56. A region where recording is assumed to be performed is the recording region 56. A region outside the recording region 56 where recording is not performed is referred to as a marginal region 58. When the rectangular recording media 48 are bound at a single position, for convenience of turning of the pages of the recording media 48, the recording media 48 are bound at a corner portion 60 of the rectangular shape, which is, for example, an upper left corner portion. The combining region 50 is formed at the corner portion 60 by pinching the recording media 48 at the corner portion 60 with the upper tooth row 34 and the lower tooth row 36.

Figure 12:
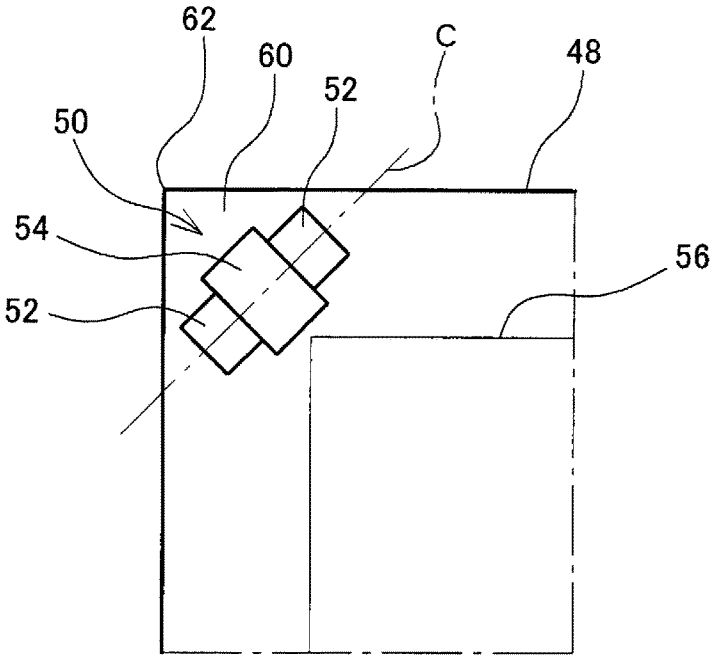
FIG. 12 is an enlarged view of a corner portion of the bound recording media.
Figure 13:
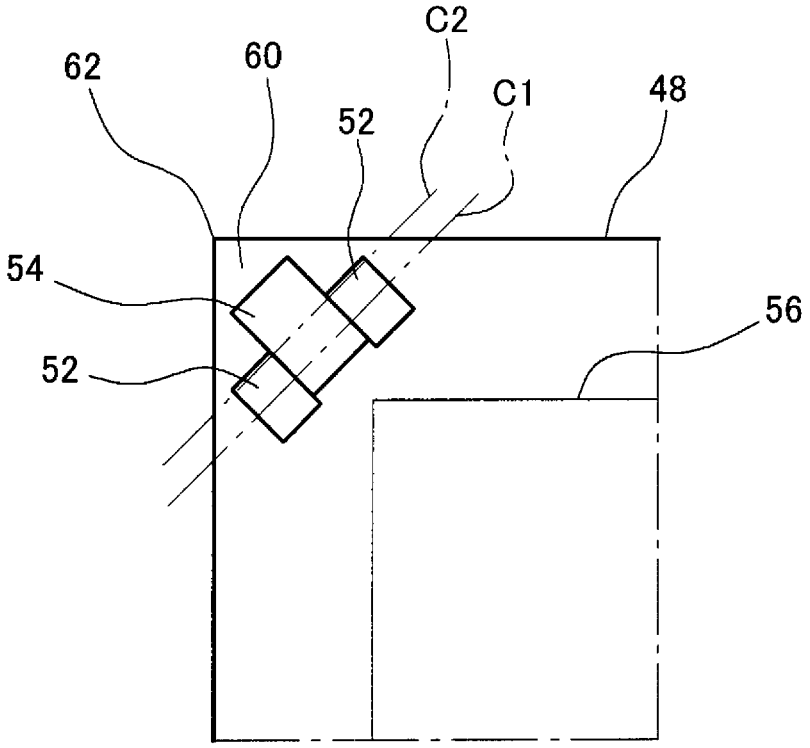
FIG. 13 is an enlarged view of the corner portion of the bound recording media.

FIGS. 12 and 13 are enlarged views of the corner portion 60 and a region around it of the recording media 48 bound at the corner portion 60. FIG. 12 illustrates the combining region 50 of the recording media 48 bound to one another with the upper tooth row 34 and the lower tooth row 36 when, in the lower tooth row 36, the centers of the effective tooth tops of the lower high teeth 40 are aligned with the centers of the effective tooth tops of the lower low teeth 42 in the tooth width direction. A center line C of the high-wave portions 52 and the low-wave portion 54 is coincident with the center line that passes through the centers of the effective tooth tops of the teeth in the high tooth ranges 44 and the centers of the effective tooth tops of the teeth in the low tooth range 46, and the center line C intersects the upper side and the left side of the recording media 48 at intersecting angles of, for example, 45°±5°. With the lower tooth row 36 in which the low tooth range 46 having a large effective tooth width is interposed between the high tooth ranges 44, the combining region 50 is formed in which the low-wave portion 54 having a large width is interposed between the high-wave portions 52 having a small width. With this arrangement of the low-wave portion 54 and the high-wave portions 52, the combining region 50 may be formed close to the corner of the recording media 48 and separated from the recording region 56 more easily than with a reverse arrangement, that is, an arrangement in which a high-wave portion 52 is interposed between low-wave portions 54.

In order to form the combining region 50 in the recording media 48 as described above, the recording-medium binding device 10 is disposed relative to the accumulation tray 30 such that the recording-medium binding device 10 faces the corner portion 60 of the recording media 48 accumulated in the accumulation tray 30 and the center line that passes through the centers of the effective tooth tops of the teeth in the high tooth ranges 44 and the centers of the effective tooth tops of the teeth in the low tooth range 46 intersects the sides of the recording media 48.

FIG. 13 illustrates the combining region 50 of the recording media 48 bound to one another with the upper tooth row 34 and the lower tooth row 36 when the centers of the effective tooth tops of the lower high teeth 40 are shifted from the centers of the effective tooth tops of the lower low teeth 42 in the tooth width direction. A center line C1 of the high-wave portions 52 is coincident with the center line passing through the centers of the effective tooth tops in the high tooth ranges 44. A center line C2 of the low-wave portion 54 is coincident with the center line passing through the centers of the effective tooth tops in the low tooth range 46. The center line C2 of the low-wave portion 54 is shifted toward a corner 62 relative to the center line C1 of the high-wave portions 52. Furthermore, the center lines C1 and C2 intersect the upper side and the left side of the recording media 48 at intersecting angles of, for example, 45°±5°. Due to the shifting of the center line C1 from the center line C2, compared to the case where the center lines of the high-wave portions 52 and the low-wave portion 54 are aligned with each other, part of the recording media 48 closer to the corner 62 may be easily used for combining the recording media 48. Furthermore, the combining region 50 may be easily formed close to the corner of the recording media 48 and easily separated from the recording region 56.

In order to form the combining region 50 in the recording media 48 as described above, the recording-medium binding device 10 is disposed relative to the accumulation tray 30 such that the recording-medium binding device 10 faces the corner portion 60 of the recording media 48 accumulated in the accumulation tray 30, the center line that passes through the centers of the effective tooth tops of the teeth in the high tooth ranges 44 and the center line that passes through the centers of the effective tooth tops of the teeth in the low tooth range 46 intersect the sides of the recording media 48, and the center line of the effective tooth tops of the low tooth range 46 is shifted relative to the center line of the effective tooth tops of the high tooth ranges 44 toward the corner 62.

The engaging heights in the high tooth ranges 44 and the low tooth range 46 are each able to be set by both the tooth height of the upper teeth and the tooth height of the lower teeth. For example, the engaging height is set also by using a tooth shape of a small tooth height and a large tooth top width as illustrated in FIG. 4 for the upper teeth in the low tooth range 46. In this case, for a fixed engaging height, the tooth height of the lower teeth increases compared to the case where the engaging height is set only with the lower teeth. Both the upper tooth row and the lower tooth row may be configured such that two inclined sides of each of the low teeth are positioned outside two inclined sides of each of the high teeth as illustrated in FIG. 4 or two inclined sides of the low tooth are superposed on two inclined sides of the high tooth as illustrated in FIG. 8. Alternatively, in one of the tooth rows, two inclined sides of the low tooth may be positioned outside two inclined sides of the high tooth, and in the other tooth row, two inclined sides of the low tooth may be superposed on two inclined sides of the high tooth.

The combination of the tooth ranges is not limited to the combination of two high tooth ranges and one low tooth range. The numbers of these ranges may be increased. The inclinations of the tooth side surfaces of the lower high tooth 40 and the lower low tooth 42, that is, the inclination angles θ1 and θ2 of the inclined sides of the isosceles trapezoidal shapes are, for example, 60° or larger. With the inclination angles θ1 and θ2 set to 60° or larger, breakage of the recording media caused by the end corners of the tooth tops may be suppressed. Furthermore, the inclination angles θ1 and θ2 of the inclined sides of the lower high tooth 40 and the lower low tooth 42 may be different from each other. The inclination angle of two inclined sides of each of the upper teeth 38 may be the same as the inclination angle of either the lower high tooth 40 or the lower low tooth 42. Alternatively, the inclination angle of the inclined sides of the upper tooth 38 may be different from that of the lower high tooth 40 and different from that of the lower low tooth 42. The shape of the teeth when seen in the tooth arrangement direction is not limited to the isosceles trapezoidal shape. The shape of the teeth when seen in the tooth arrangement direction may be, for example, any of usual trapezoidal shapes, a rectangular shape, or a shape having a trapezoidal shape on the tooth top side and a rectangular shape on the tooth bottom side.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording-medium binding device comprising:

a first tooth row that includes a plurality of teeth arranged in a tooth arrangement direction; and a second tooth row that includes a plurality of teeth, that is to be engaged with the first tooth row, and that cooperates with the first tooth row to bind recording media by pinching a batch of the recording media, wherein, in the tooth arrangement direction, one of the first tooth row and the second tooth row has at least one first range and at least one second range, wherein, in the at least one first range, an engaging height by which at least one tooth of the plurality of teeth of the first tooth row and at least one tooth of the plurality of teeth of the second tooth row are engaged with each other is a first engaging height, and a width of an effective tooth top is a first effective tooth top width, and wherein, in the at least one second range, the engaging height is a second engaging height that is smaller than the first engaging height, and a width of an effective tooth top is a second effective tooth top width that is larger than the first effective tooth top width, wherein the at least one first range includes a plurality of first ranges disposed at both ends in the tooth arrangement direction.

2. The recording-medium binding device according to claim 1, wherein each of the plurality of teeth of the first tooth row has a tooth top, a top end portion, and a tooth bottom, and each of the plurality of teeth of the second tooth row has a tooth top, a top end portion, and a tooth bottom, and wherein, in each of the plurality of teeth of the first tooth row, at least the top end portion has a trapezoidal shape a width of which increases from a tooth top side toward a tooth bottom side when seen in the tooth arrangement direction, and in each of the plurality of teeth of the second tooth row, at least the top end portion has a trapezoidal shape a width of which increases from a tooth top side toward a tooth bottom side when seen in the tooth arrangement direction.

3. The recording-medium binding device according to claim 2, wherein, in the at least one first range and the at least one second range, the trapezoidal shape of each of the plurality of teeth of the first tooth row has two inclined sides, and the trapezoidal shape of each of the plurality of teeth of the second tooth row has two inclined sides, wherein, in at least one of the first tooth row and the second tooth row, the at least one tooth of the plurality of teeth in the at least one first range has a different tooth height and a different tooth top width from a tooth height and a tooth top width of the at least one tooth of the plurality of teeth in the at least one second range, and wherein, in at least one of the first tooth row and the second tooth row, when seen in the tooth arrangement direction, the two inclined sides of the at least one of the plurality of teeth in the at least one second range are superposed on the two inclined sides of the at least one tooth of the plurality of teeth in the at least one first range.

4. The recording-medium binding device according to claim 2, wherein the trapezoidal shape of each of the plurality of teeth of the first tooth row has an inclined side inclined relative to a height direction at 60° or larger, and the trapezoidal shape of each of the plurality of teeth of the second tooth row has an inclined side inclined relative to the height direction at 60° or larger.

5. The recording-medium binding device according to claim 1, wherein either or both of the at least one first range and the at least one second range are provided in a plurality, and wherein the at least one first range and the plurality of second ranges, the plurality of first ranges and the at least one second range, or the plurality of first ranges and the plurality of second ranges are arranged in an alternating sequence.

6. The recording-medium binding device according to claim 1, wherein, in a tooth width direction, a center of the effective tooth top in each of the plurality of first ranges and a center of the effective tooth top in the at least one second range are shifted from each other.

7. The recording-medium binding device according to claim 6, wherein the recording media to be bound have a rectangular shape and have a corner and a side, wherein the batch of the recording media has a corner, wherein the corner of the batch of the recording media is pinched in a state in which the tooth arrangement direction of the first tooth row and the second tooth row extends in a direction that intersects the side of the recording media and a direction in which the center of the effective tooth top of the at least one tooth of the plurality of teeth in the at least one second range is shifted from the center of the effective tooth top of each of the plurality of teeth in the plurality of first ranges is oriented to the corner of the recording media.

8. A recording-medium post processing apparatus comprising:

a recording-medium accumulation unit in which a plurality of rectangular recording media are accumulated so as to be formed into a batch of the plurality of recording media having a side, a corner, and a corner portion; and a recording-medium binding device according to claim 6 disposed relative to the recording-medium accumulation unit such that the first tooth row and the second tooth row face the corner portion of the batch of the plurality of recording media, the tooth arrangement direction of the first tooth row and the second tooth row extends in a direction that intersects the side of the batch of the plurality of recording media, and a direction in which the center of the effective tooth top of the at least one tooth of the plurality of teeth in the at least one second range is shifted from the center of the effective tooth top of each of the plurality of teeth in the plurality of first ranges is oriented to the corner of the batch of the plurality of recording media.

9. A recording-medium binding device comprising:

a first tooth row that includes a plurality of teeth arranged in a tooth arrangement direction; and a second tooth row that includes a plurality of teeth, that is to be engaged with the first tooth row, and that cooperates with the first tooth row to bind recording media by pinching a batch of the recording media, wherein, in the tooth arrangement direction, one of the first tooth row and the second tooth row has at least one first range and at least one second range, wherein, in the at least one first range, an engaging height by which at least one tooth of the plurality of teeth of the first tooth row and at least one tooth of the plurality of teeth of the second tooth row are engaged with each other is a first engaging height, and a width of an effective tooth top is a first effective tooth top width, and wherein, in the at least one second range, the engaging height is a second engaging height that is smaller than the first engaging height, and a width of an effective tooth top is a second effective tooth top width that is larger than the first effective tooth top width, wherein each of the plurality of teeth of the first tooth row has a tooth top, a top end portion, and a tooth bottom, and each of the plurality of teeth of the second tooth row has a tooth top, a top end portion, and a tooth bottom, and wherein, in each of the plurality of teeth of the first tooth row, at least the top end portion has a trapezoidal shape a width of which increases from a tooth top side toward a tooth bottom side when seen in the tooth arrangement direction, and in each of the plurality of teeth of the second tooth row, at least the top end portion has a trapezoidal shape a width of which increases from a tooth top side toward a tooth bottom side when seen in the tooth arrangement direction, wherein the at least one first range includes a plurality of first ranges disposed at both ends in the tooth arrangement direction, wherein each of the plurality of teeth of the first tooth row has two inclined sides of the trapezoidal shape, and each of the plurality of teeth of the second tooth row has two inclined sides of the trapezoidal shape, wherein the first tooth row and the second tooth row have respective first side surfaces disposed on an identical side and respective second side surfaces disposed on an opposite side to the first side surfaces, wherein, in the first tooth row and the second tooth row, when seen in the tooth arrangement direction, one of the two inclined sides of the trapezoidal shape of the at least one tooth of the plurality of teeth in the at least one second range is superposed on one of the two inclined sides of the trapezoidal shape of the at least one tooth of the plurality of teeth in each of the plurality of the first ranges, and wherein, regarding the second side surfaces of the plurality of first tooth rows and the at least one second tooth row, when seen in the tooth arrangement direction, another inclined side of the trapezoidal shape of the at least one tooth of the plurality of teeth in the at least one second range is positioned outside another inclined side of the trapezoidal shape of the at least one tooth of the plurality of teeth in each of the plurality of first ranges in at least one of the first tooth row and the second tooth row.

10. The recording-medium binding device according to claim 9, wherein the recording media to be bound have a rectangular shape, a corner, and a side, wherein the batch of the recording media has a corner portion, wherein the tooth arrangement direction of the first tooth row and the second tooth row extends in a direction that intersects the side of the recording media, and wherein the corner portion of the batch of the recording media is pinched in a state in which the second side surfaces of the first tooth row and the second tooth row face the corner of the recording media.

11. A recording-medium post processing apparatus comprising:

a recording-medium accumulation unit in which a plurality of rectangular recording media are accumulated so as to be formed into a batch of the plurality of recording media having a side, a corner, and a corner portion; and a recording-medium binding device according to claim 9 disposed relative to the recording-medium accumulation unit such that the first tooth row and the second tooth row face the corner portion of the batch of the plurality of recording media, the tooth arrangement direction of the first tooth row and the second tooth row intersects the side of the batch of the plurality of recording media, and the second side surfaces of the first tooth row and the second tooth row face the corner of the batch of the plurality of recording media.

12. A recording-medium binding device comprising:

a first tooth row that includes a plurality of teeth arranged in a tooth arrangement direction; and a second tooth row that includes a plurality of teeth, that is to be engaged with the first tooth row, and that cooperates with the first tooth row to bind recording media by pinching a batch of the recording media, wherein, in the tooth arrangement direction, one of the first tooth row and the second tooth row has at least one first range and at least one second range, wherein, in the at least one first range, an engaging height by which at least one tooth of the plurality of teeth of the first tooth row and at least one tooth of the plurality of teeth of the second tooth row are engaged with each other is a first engaging height, and a width of an effective tooth top is a first effective tooth top width, and wherein, in the at least one second range, the engaging height is a second engaging height that is smaller than the first engaging height, and a width of an effective tooth top is a second effective tooth top width that is larger than the first effective tooth top width, wherein the plurality of teeth included in the first tooth row are identical in tooth top width and tooth height.

* * * * *